US006398453B1

(12) United States Patent
Stegemoeller

(10) Patent No.: US 6,398,453 B1
(45) Date of Patent: Jun. 4, 2002

(54) TELESCOPING SPREADER BOX WITH REPLACEABLE STRIKE-OFF SYSTEM

(75) Inventor: Calvin Lynn Stegemoeller, Hewitt, TX (US)

(73) Assignee: Akzo Nobel Asphalt Applications, Inc., Waco, TX (US)

( * ) Notice: Subject to any disclaimer, the term of this patent is extended or adjusted under 35 U.S.C. 154(b) by 0 days.

(21) Appl. No.: 09/412,123

(22) Filed: Oct. 5, 1999

Related U.S. Application Data

(63) Continuation-in-part of application No. 09/126,465, filed on Jul. 30, 1998, now Pat. No. 5,980,153.

(51) Int. Cl.[7] ..... E01C 19/18; B67D 3/00
(52) U.S. Cl. ..... 404/108; 404/118; 222/527
(58) Field of Search ..... 404/75, 108, 118, 404/110; 222/342, 527; 15/235.4

(56) References Cited

U.S. PATENT DOCUMENTS

| | | | | | |
|---|---|---|---|---|---|
| 2,328,888 | A | | 9/1943 | Bell | 404/92 |
| 3,260,176 | A | | 7/1966 | Bowers | 94/39 |
| 3,353,798 | A | | 11/1967 | Draper et al. | 259/149 |
| 3,453,939 | A | | 7/1969 | Pollitz et al. | 94/46 |
| 3,478,830 | A | | 11/1969 | Levesque et al. | 177/1 |
| 3,782,844 | A | * | 1/1974 | Burgin | 404/84 |
| 3,820,914 | A | | 6/1974 | Zimmerman | 404/110 |
| 3,872,601 | A | * | 3/1975 | Burgin | 404/118 |
| 3,967,912 | A | | 7/1976 | Parker | 404/84 |
| 4,012,160 | A | | 3/1977 | Parker | 404/84 |
| 4,089,509 | A | | 5/1978 | Morton et al. | 366/8 |
| 4,222,498 | A | | 9/1980 | Brock | 222/58 |
| 4,298,288 | A | | 11/1981 | Weisbrod | 366/8 |
| 4,298,555 | A | | 11/1981 | Weltmer | 264/31 |
| 4,449,845 | A | * | 5/1984 | Carrillo | 404/118 |
| 4,475,818 | A | | 10/1984 | Bialkowski | 366/17 |
| 4,492,490 | A | * | 1/1985 | Christine et al. | 404/108 |
| 4,506,982 | A | | 3/1985 | Smithers et al. | 366/19 |
| 4,534,674 | A | | 8/1985 | Cutler | 404/75 |
| 4,572,701 | A | * | 2/1986 | Parsons et al. | 404/50 |
| 4,708,520 | A | | 11/1987 | Rowe | 404/103 |
| 4,749,304 | A | | 6/1988 | Craig | 404/101 |
| 4,772,156 | A | | 9/1988 | Craig | 404/101 |
| 4,781,466 | A | | 11/1988 | Zimmerman | 366/2 |
| 4,823,366 | A | | 4/1989 | Williams | 377/2 |
| 4,856,932 | A | * | 8/1989 | Kraft | 404/118 |
| 5,002,426 | A | | 3/1991 | Brown et al. | 404/92 |
| 5,044,819 | A | | 9/1991 | Kilheffer et al. | 404/72 |
| 5,099,986 | A | | 3/1992 | Kuzub | 198/666 |
| 5,120,155 | A | | 6/1992 | Samspon | 404/110 |
| 5,232,305 | A | * | 8/1993 | Bassett et al. | 404/101 |
| 5,240,324 | A | | 8/1993 | Phillips et al. | 366/132 |
| 5,294,210 | A | | 3/1994 | Lemelson et al. | 404/84.1 |
| 5,330,265 | A | | 7/1994 | Keating, Jr. et al. | 366/7 |
| 5,376,950 | A | | 12/1994 | Soderholm et al. | 346/16 |
| 5,379,479 | A | * | 1/1995 | Nelson | 15/245.1 |
| 5,549,413 | A | * | 8/1996 | Bolden | 404/93 |
| 5,590,976 | A | | 1/1997 | Kilheffer et al. | 404/72 |
| 5,778,482 | A | * | 7/1998 | Sbrigato | 15/245.1 |
| 5,899,630 | A | * | 5/1999 | Brock | 404/79 |

OTHER PUBLICATIONS

Akzo Nobel, "Micro–Surfacing for Road Maintenance"; Company Brochure, Sep. 1998.

* cited by examiner

*Primary Examiner*—H. Shackelford
*Assistant Examiner*—Gary S. Hartmann
(74) *Attorney, Agent, or Firm*—Baker Botts L.L.P.

(57) ABSTRACT

A paving system having a strike-off assembly and method of manufacture is provided that distributes paving material onto a road surface. The strike-off assembly comprises a screed assembly comprised in a guide frame. The screed assembly comprises a flexible screed having a first and second surface secured in a screed track. The screed assembly may be disposed behind a mobile paving system to regulate the amount of paving material distributed onto the road surface and to ensure a generally even distribution of paving material across the road surface. After the surface of the flexible screed has become worn or damaged from use, the screed assembly may be removed and reversed such that the second surface is employed to regulate and distribute paving material onto the road surface.

15 Claims, 4 Drawing Sheets

TELESCOPING SPREADER BOX WITH REPLACEABLE STRIKE-OFF SYSTEM

RELATED APPLICATIONS

This is a Continuation-in-Part Application of Ser. No. 09/126,465 entitled Telescoping Auger Shaft and Method of Manufacture filed on Jul. 30, 1998 by Carl Dean Plemons et al., now U.S. Pat. No. 5,980,153.

TECHNICAL FIELD OF THE INVENTION

The present invention relates generally to the field of road construction equipment and more particularly to a strike-off system and method of manufacture.

BACKGROUND OF THE INVENTION

Asphalt emulsion based surface treatments such as asphalt slurry and microsurfacing are used to maintain asphalt pavements. The application of such surface treatments extends the life of existing pavements and repairs pavement surface problems such as raveling (loss of aggregate), weathering, wheel path rutting, and loss of roughness or slick wheel paths. The slurry can be mixed by a mobile paving system and applied to the pavement surface in a continuous or batch process. One such mobile paving system is disclosed in U.S. Pat. No. 5,590,976, entitled "Mobile Paving System Using an Aggregate Moisture Sensor and Method of Operation."

A mobile paving system can deposit slurry onto a surface through spreader box pulled behind a slurry machine. The ability of the mobile paving system to satisfactorily apply the slurry to the surface can depend upon the ability of the system to evenly distribute the slurry across the full width of the spreader box. Typically a flexible strike-off bar or screed is attached to the spreader box to facilitate generally even distribution of the paving material deposited from the spreader box.

A dual strike-off assembly may be used in which two flexible strike-off bars are positioned behind the spreader box disposed generally parallel to one another. The first strike-off bar may be positioned forward of the second strike-off bar and serve to regulate the amount of paving material deposited on the road surface. The first strike-off bar may be positioned to allow a desired amount of paving material to pass under the first strike-off bar and push forward excess paving material. The second strike-off bar may be positioned to allow the leading edge of the second strike-off bar to contact the road surface in order to smooth and level the deposited paving material to obtain the desire surface texture.

The spreader box width generally determines the width of the road surface that can be treated. Some currently available systems allow operators to expand or contract the spreader box width. The strike-off assembly must similarly adjust in width to facilitate deposition of material along the expanded width of the spreader box. Some currently strike-off systems may automatically expand and contract as the spreader box expands and contracts.

A currently available strike-off assembly may comprise a housing of adjustable length and a flexible screed with a length approximately equal to the maximum width of an expandable spreader box. The housing may lengthen or shorten to match the width of the spreader box. As the housing lengthens it engages the flexible screed. When the housing is lengthened to its maximum length, it may engage the entire length of the flexible screed. When the housing is not expanded to its maximum width, the excess length of the flexible screed can be pulled out of the path of the mobile paving system with flexible tensioning devices. Currently available flexible screeds may provide an elongated molded rubber strip with an asymmetrical cross section. Current flexible screeds are typically molded from a single material and often have a generally L-shaped cross section.

One difficulty with such systems is that molding of flexible strip to obtain suitable geometries is expensive and time consuming. Another difficulty with such systems is that the flexible strip may be housed in a generally hollow housing with an elongated slot. Removal and installation of the flexible member can be time consuming and burdensome, especially when the flexible member and housing are covered with hardened slurry materials. Yet another difficulty with such systems is that an asymmetrical strip is not reversible and only a single side of the strip may be utilized to distribute paving materials.

SUMMARY OF THE INVENTION

In accordance with teachings of the present invention, a paving system having a strike-off assembly and method of manufacture are disclosed that provide advantages over previously developed paving systems.

According to one embodiment of the present invention, a mobile paving system with a strike-off assembly for distributing slurry materials onto a road surface is provided. The mobile paving system comprises a mobile paving vehicle with a mixer coupled to the mobile paving vehicle. A spreader box is coupled to the mixer behind the path of the vehicle which distributes paving materials onto the road surface. A strike-off assembly is typically coupled adjacent the spreader box for distributing the surface materials or slurry deposited by the spreader box. The strike-off assembly comprises a screed track and flexible screed which is formed to fit within the screed track.

According to another embodiment of the present invention the mobile paving system further comprises a guide frame coupled to the spreader box. The guide frame may comprise an elongated member with a longitudinal slot extending therethrough and formed to engage the strike-off assembly.

According to another embodiment of the present invention the mobile paving system further comprises a spreader box of expandable width. In this embodiment the guide frame can have a selectively variable length. The guide frame may be coupled tot he spreader box such that as the spreader box expands or contracts the guide frame and the length of the strike-off assembly engaged by the guide frame may expand or contract.

A further embodiment of the present invention is disclosed wherein the screed track and flexible screed are comprised of materials sufficiently flexible to allow the length of the strike-off assembly which is not engaged by the expandable guide frame assembly to be pulled away from the road surface. The screed track comprises a material sufficiently rigid to facilitate its installation and removal into the guide frame.

Yet another embodiment of the present invention is disclosed wherein a secondary guide frame and screed assembly are disposed behind the first guide frame and screed assembly. This preferred embodiment allows an operator to regulate the amount of material deposited onto the road surface with the first screed assembly and use the secondary screed assembly to give the distributed paving material a desired surface texture.

A technical advantage of the present invention is that the screed assembly may be assembled from simple components. The screed track preferably has a generally symmetrical cross section such as a U-shaped bar and the flexible screed may comprise a strip of flexible material cut from a larger sheet of material. It is also a technical advantage that the screed track may be reused with a replacement flexible screed. It is also a technical advantage of the present invention that the flexible screed may be cut along its length to create a fresh leading edge when the leading edge of the flexible screed becomes worn from use.

A further technical advantage of the present invention is the use of material for the screed track which is sufficiently flexible to allow the screed assembly to be pulled away from the road surface and sufficiently rigid to facilitate the installation and removal of the screed assembly into the guide frame.

A further technical advantage of the present invention is that the flexible screed has a generally symmetrical configuration such as a rectangular cross section which allows the flexible screed to be reversed. This allows both faces of the flexible screed to be utilized, extending the life of the screed assembly and reducing the frequency of replacing the flexible screed.

Additional technical advantages of the present invention should be apparent to one of ordinary skill in the art from the description, drawings, and claims.

BRIEF DESCRIPTION OF THE DRAWINGS

A more complete understanding of the present invention and advantages thereof may be acquired by referring to the following description taken in conjunction with the accompanying drawings in which like reference numbers indicate like features and wherein.

DETAILED DESCRIPTION OF THE INVENTION

Figure 1:
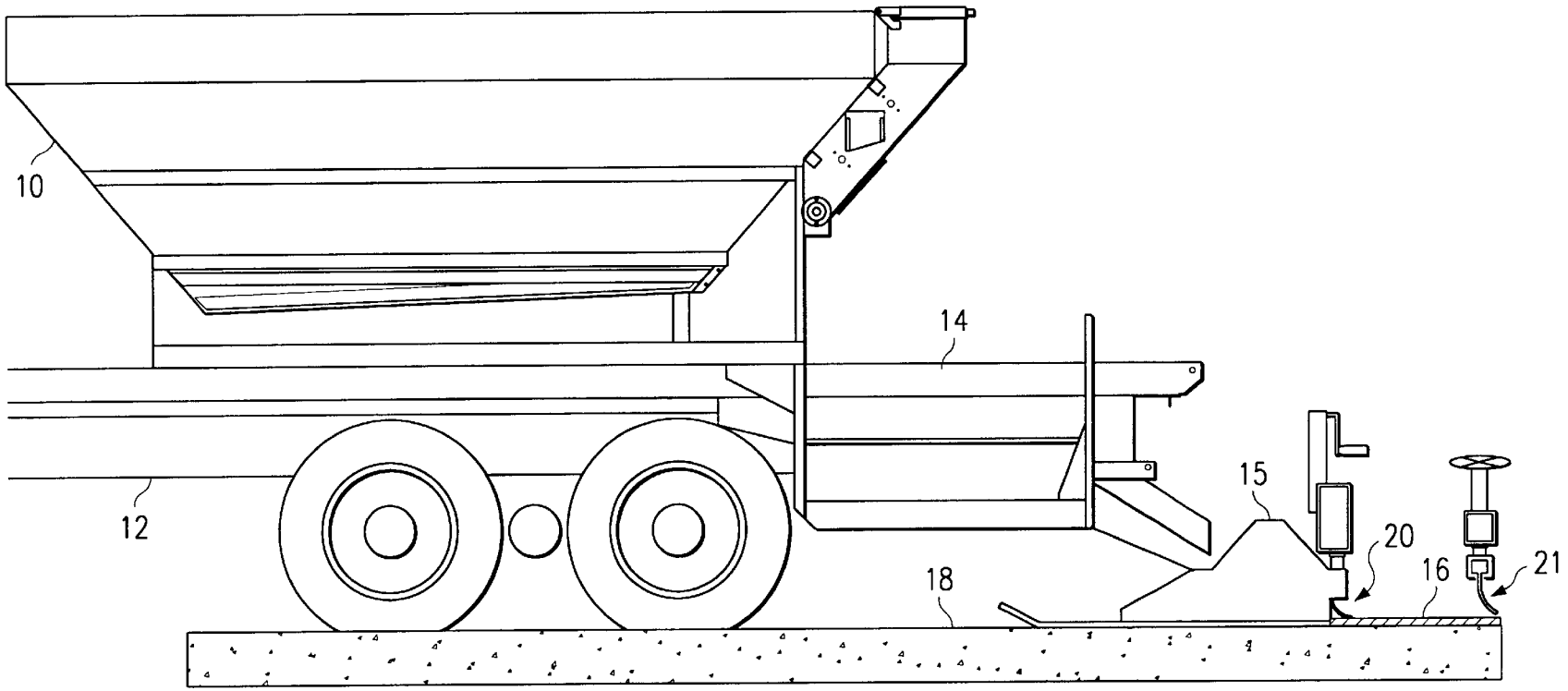
FIG. 1 is a schematic diagram with a portion broken away of a mobile paving vehicle with a dual strike-off assembly.

FIG. 1 is a schematic diagram showing portions of a mobile paving system incorporating the mobile paving system, indicated generally at 10, comprising vehicle 12 in connection with mixer 14, in connection with spreader box 15. The spreader box 15 connects with a strike-off system 20. In operation, mobile paving system 10 travels along a road surface 18. Mobile paving system 10 collates paving material 16 in mixer 14 and deposits the slurry into spreader box 15. Paving material 16 may comprise an aggregate, slurry, or any material employed to surface a road or street. Typically, an apparatus such as an auger (not expressly shown) extends across the inside of spreader box 15 and evenly distributes the paving material 16 throughout the spreader box 15. Spreader box 15 deposits the paving material 16 onto road surface 18. The first strike-off system 20 operates to provide even application of paving material 16. The first strike-off system 20 can be positioned to regulate the amount of paving material 16 which is deposited onto road surface 18.

Spreader box 15 may be an expandable spreader box, having a variable width. In general, an expandable spreader box comprises sides that can be moved, for example by hydraulic rams (not expressly shown), such that spreader box 15 can apply paving material 16 to road surfaces 18 of varying widths.

Figure 2:
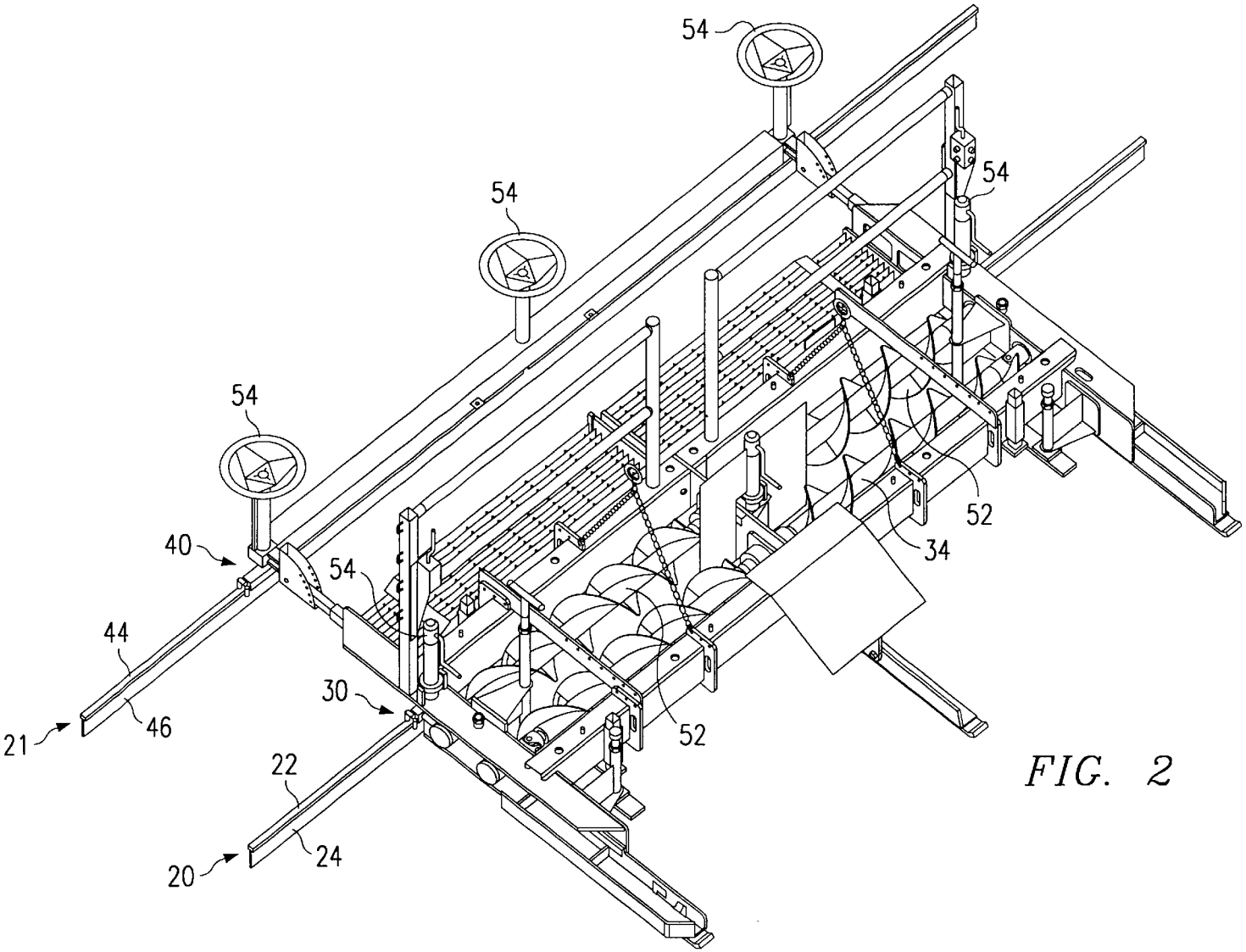
FIG. 2 is a schematic diagram of an expandable spreader box and expandable dual screed assembly incorporating the teachings of the present invention.

FIG. 2 is a schematic diagram of one preferred embodiment of an expandable spreader box and expandable dual strike-off system according to the present invention. As shown, expandable spreader box 34 can comprise two sections which can be independently expanded. In this embodiment, each section contains two expandable guide frame assemblies 30 and 40. In particular, guide frame assemblies 30 and 40 are positioned parallel to one another and are coupled to the spreader box 34 such that when the spreader box expands or contracts the guide frames 30 and 40 expanded contract. A first strike-off assembly 20 comprising a first screed track 22 and a first flexible screed 24 secured within the first screed track 22 is slidably engaged by the first guide frame assembly 30. A second strike-off assembly 21 comprising a second screed track 44 and a second flexible screed 46 secured within the second screed track 44 is slidably engaged within the second guide frame assembly 40.

In operation, expandable spreader box 34 may be pulled behind a mobile paving system 10 in the direction indicated in FIG. 2. Paving material is distributed in spreader box 34 where rotating auger shafts evenly distribute the paving material throughout the expandable spreader box 34. As the mobile paving system moves forward the first strike-off assembly 20 and the second strike-off assembly 21 pass over the paving material 16 deposited onto the road surface. The first strike-off assembly 20 acts to control the amount of material deposited onto the road surface by allowing the desired amount of paving material to pass beneath it and pushing excess paving material forward. The operator may control the amount of paving material deposited on the road surface by selectively positioning the height of the first strike-off assembly 20 above the road surface. The operator may selectively position the height of the first strike-off system assembly 20 using hand jacks 54. The second strike-off 21 assembly sweeps across the deposited surface materials to ensure the even application of the materials and to provide the road surface with the desired surface texture. The operator may selectively position the height and the angle of the second strike-off assembly 21 by operating a hand jack and a strike-off pivot assembly respectively.

In operation, as the expandable spreader box 34 expands or contracts the guide frames 30 and 40 expand or contract. As the guide frames 30 and 40 expand or contract the guide frame engage or disengage the screed assemblies. When performing a paving operation on a surface whose width is within the expandable range of the expandable spreader box 34, the operator may select the width of the spreader box and the corresponding length of the first strike-off assembly 20 and the second strike-off assembly 21 to resurface the width of the road with a single pass. When the paving operation is performed on a wider road surface, the width of the expandable spreader box 34 and the corresponding width of the strike-off assemblies 20 and 21 may be selected to allow the paving operation to be completed without requiring overlapping passes of the mobile paving system 10.

Figure 3:
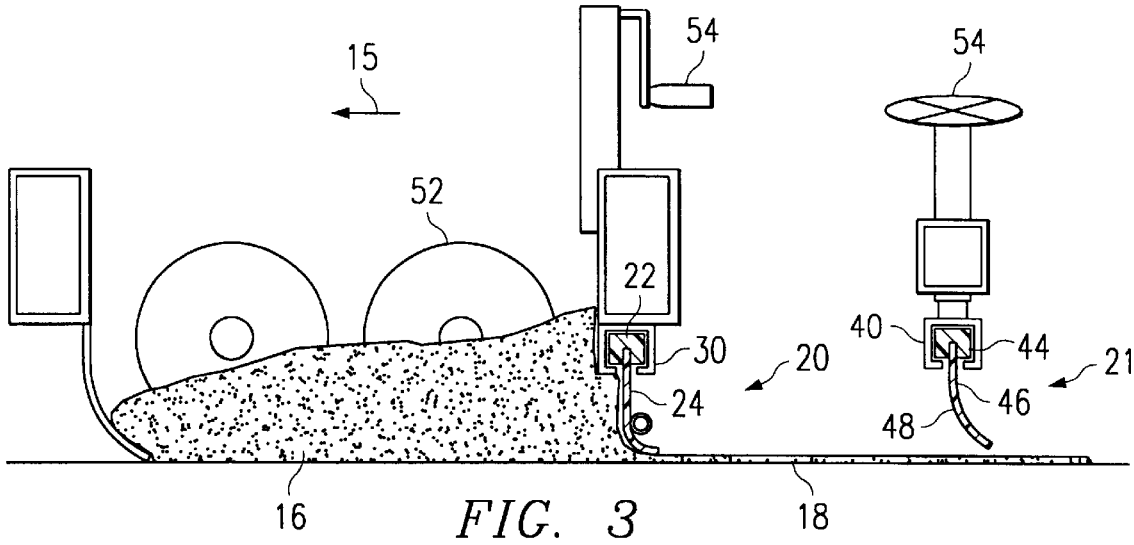
FIG. 3 is a schematic drawing showing a side cut away view of a spreader box with a dual strike-off assembly incorporating the teachings of the present invention.

FIG. 3 is a schematic drawing showing a side cutaway view of a spreader box 15 and dual strike-off assembly 20 and 21 in operation. Spreader box 15 mixes and distributes paving material 16 on a road surface 18. A first strike-off assembly 20 is positioned adjacent the spreader box 15. The first strike-off assembly 20 comprises a first flexible screed 24 attached to a first screed track 22. First screed track 22 and first flexible screed 24 are preferably removably engaged within first guide frame assembly 30. Second strike-off assembly 21 is positioned behind the first strike-off assembly 20. Second strike-off assembly comprises a second flexible screed 46 attached to a second screed track 44. The second screed track 44 and second flexible screed 46 are preferably removably engaged within the second guide frame assembly 40. The vertical position of either first strike-off system 20 or second strike-off system 21 may be selected using hand jacks 54 or other means for raising or lowering the strike-off assemblies 20 and 21.

In operation paving material 16 is preferably distributed throughout the spreader box 15 with expandable augers 52. As the mobile paving system moves forward paving material gathers at the rear wall of the spreader box 15. First strike-off system 20 allows the desired amount of paving material 16 to pass beneath the first flexible screed 24, resulting in a generally uniform layer of paving material 16. Second strike-off assembly 21 then passes over the layer of paving material 16. Front surface 48 of second flexible screed 46 preferably contacts and conditions the layer of paving material 16. The operator may selectively adjust the position of the second strike-off assembly 21 to give the road surface a desired surface texture.

Figure 4:
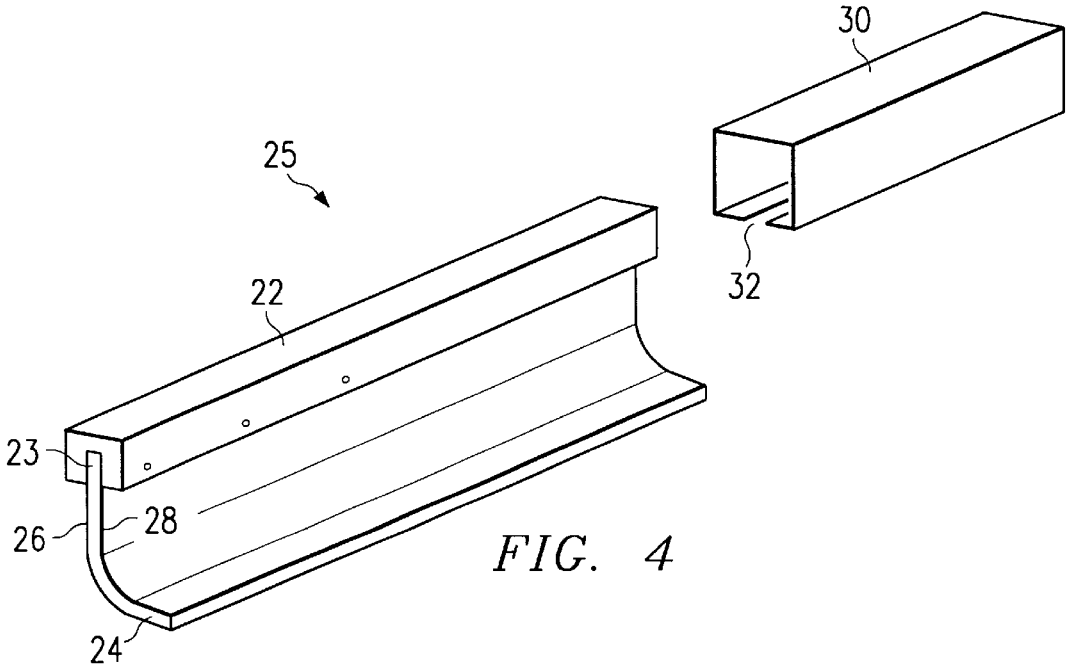
FIG. 4 is a schematic drawing showing an isometric view of a strike-off assembly incorporating the teachings of the present invention.

FIG. 4 is a schematic drawing showing an isometric view of a strike-off assembly according to the present invention. The first flexible screed 24 is releasably secured within first screed track slot 23 of the first screed track 22. First screed track 22 and flexible screed 24 may slidably engage the first guide frame assembly 30. The first guide frame 30 is preferably formed to receive the first screed track 22 and first flexible screed 24. In a preferred embodiment the first guide frame axial slot 32 is generally centered along the bottom of the first guide frame assembly 30. The first screed track axial slot 23 is formed to receive the first flexible screed 24.

When the first flexible screed 24 is releasably secured to the first screed track 22, the first flexible screed surface 26 may be disposed adjacent to the paving material in the spreader box. The first flexible screed 24 further comprises a second flexible screed surface 28 which may be disposed adjacent to the paving material in the spreader box. In operation, an operator may install the first screed assembly 25 in the guide track 30 such that the first surface 26 of the first flexible screed 24 may sweep across the road surface and the deposited paving material as the mobile paving system proceeds forward. The operator may also remove and reinsert the first screed assembly 25 into the first guide frame assembly such that the second surface 28 of the first flexible screed 24 may sweep across the road surface as the mobile paving system proceeds.

It is a technical advantage of the current invention that both surfaces of the flexible screed may be employed. In operation when one surface becomes worn or damaged from use, the screed assembly 25 may simply be reversed to utilized the second surface of the flexible screed. It is also a technical advantage of the current invention that when the leading edge of the first flexible screed 24 becomes damaged or worn, the first flexible screed 24 may be trimmed to create a new leading edge.

In a preferred embodiment of the present invention the slot 32 of the first guide frame assembly 30 is generally centered along the bottom of the first guide frame assembly 30. It is a technical advantage of the current invention to have the guide frame slot generally centered along the bottom of the first guide frame assembly 30. Centering the axial slot along the bottom of the first guide frame assembly 30 facilitates the reversal of the first flexible screed 24 surfaces.

Figure 5:
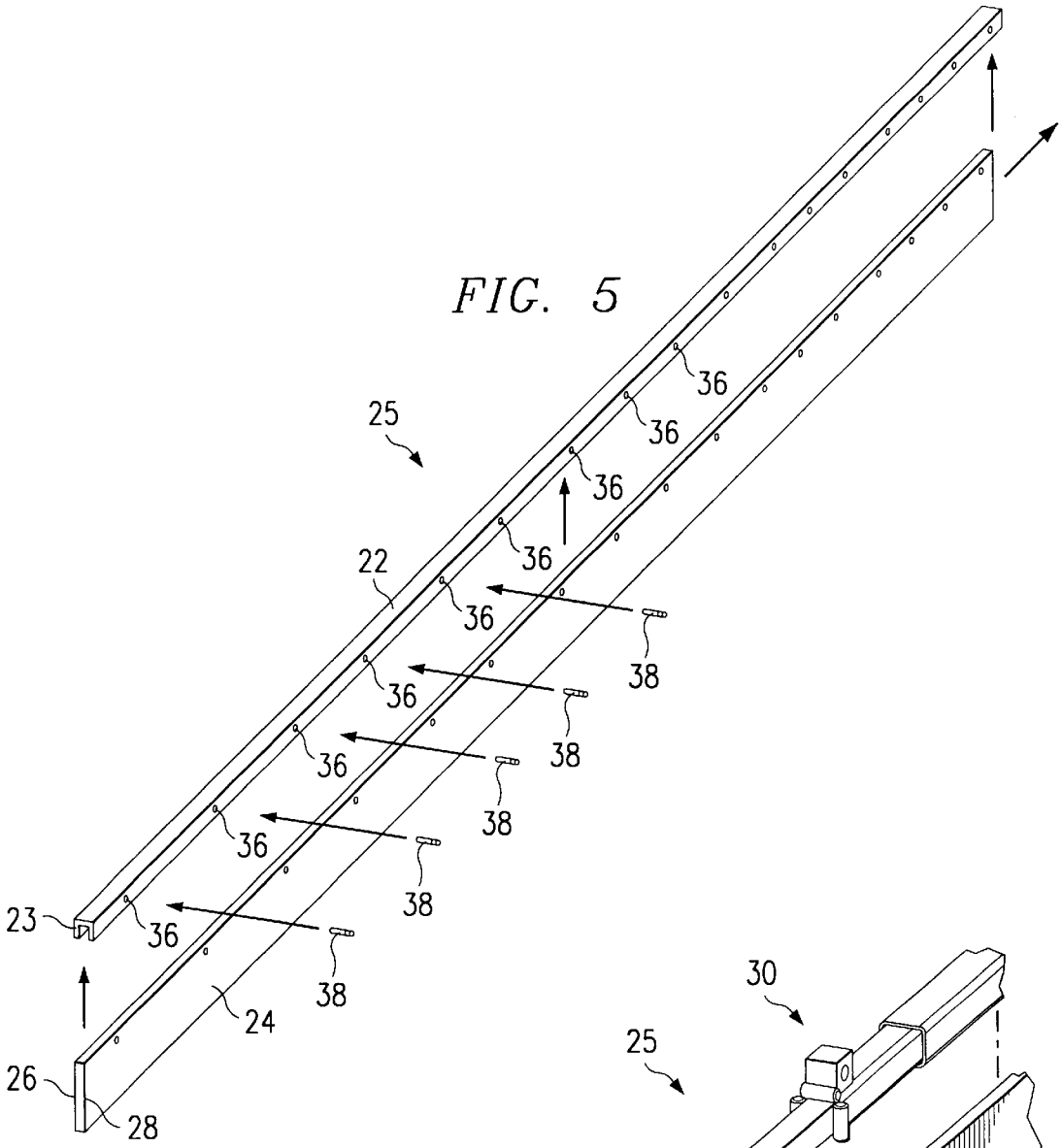
FIG. 5 is a schematic drawing showing an exploded view of a screed assembly incorporating the teachings of the present invention.

FIG. 5 is a schematic drawing showing an exploded view of a screed assembly 25 according to the present invention. A first flexible screed 24 is disclosed which may be formed from material selected from the group consisting of urethane and neoprene. The first flexible screed 24 may be inserted into the screed track slot 23 or the generally elongated first screed track 22. A plurality of lateral bores 36 may be formed to extend through first screed track 22 and first flexible screed 24 such that the lateral bores 36 of the first screed track 22 are generally aligned with the lateral bores 36 of the first flexible screed 24. A plurality of pins 38 may be respectively inserted in lateral bores 36 to releaseably secure the first flexible screed 24 to the first screed track 22. In a preferred embodiment of the present invention pins 38 may be formed from spring steel.

In operation the screed assembly 25 may be assembled by the operator at the job site. The operator may place a first end of the flexible screed 24 into a first end of the first screed track axial slot 23. The operator may then create a hole through the first screed track 22 and the first flexible screed 24, where inserted, to create a lateral bore 36. The operator may then drive a pin 38 through the lateral bore 36. Next the operator may insert the second end of flexible screed 24 into a second end of the first screed track axial slot 23, and create another lateral bore 36 through this inserted end. The operator may then insert a pin 38 into this lateral bore 36. Next, the operator may insert the length of first flexible screed 24 along the length of the first screed track axial slot 23. The operator may create a plurality of lateral bores 36 and insert a plurality of pins 38 along the length of the screed assembly 25 to secure first flexible screed 24 within the first screed track axial slot 23.

In a preferred embodiment of the present invention the plurality of lateral bores 36 may be uniformly spaced at a distance between approximately one and twelve inches from each other along the length of the screed assembly 25.

In a preferred operation, when the first flexible screed 24 has become worn from use it may be replaced while the first screed track 22 may be reused. The operator may remove pins 38 from the lateral bores 36. Next the operator may remove the first flexible screed 24 from the first screed track axial slot 23. The operator may then install a replacement first flexible screed 24 into the first screed track axial slot 23. Once placed within the first screed track axial slot 23 the operator may create a lateral bore 36 through the flexible screed 24 which communicates with existing lateral bores 36 in the first screed track 22.

The first flexible screed 24 comprises a first surface 26 and a second surface 28 such that either surface may be disposed adjacent to a road surface. It is a technical advantage of the present invention that the first flexible screed 24 comprises a first surface 26 and a second surface 28 because the first flexible screed 24 may effectively be reversed. This allows both sides of the first flexible screed 24 to be utilized before the first flexible screed 24 must be replaced. Once the first surface 26 becomes worn or damaged from use, the second surface 28 may be employed.

Figure 6:
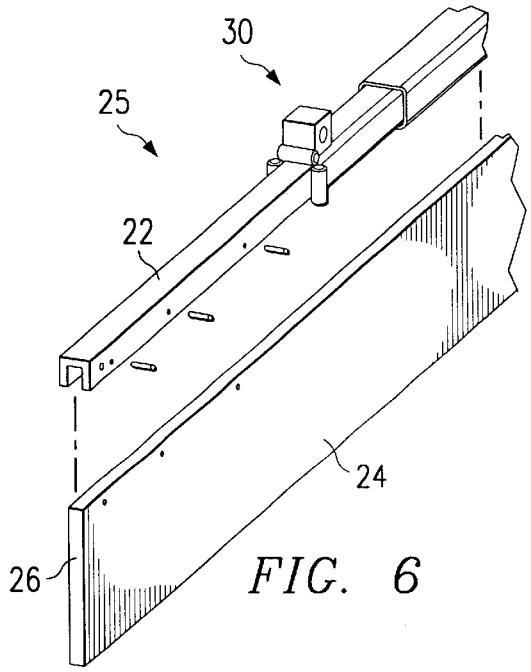
FIG. 6 is an isometric view with a portion broken away of one embodiment of a strike-off assembly incorporating the teachings of the present invention.

FIG. 6 discloses an isometric view with a portion broken away of one embodiment of a strike-off assembly according to the present invention. The strike-off assembly includes a first guide frame assembly 30 comprising an outer and inner frame. The guide frame assembly 30 may be associated with the expandable spreader box 34 such that as the spreader box expands or contracts, the first guide frame assembly 30 automatically expands or contracts. As the first guide frame assembly 30 expands it may engage an increased length of the screed assembly 25. The screed assembly 25 comprises the first flexible screed 24 secured to the first screed track 22. As the first guide frame assembly 30 contracts it may disengage a length of the screed assembly 25. The length of the screed assembly 25 which is engaged by the guide frame assembly 30 may be selectively positioned by the operator adjacent to the road surface. The length of the screed assembly 25 which is not engaged by the guide frame assembly 30 may be directed away from the road surface with flexible tensioning devices.

In a preferred embodiment the first flexible screed 24 may comprise a first flexible screed 26 with a rectangular cross-section. It is a technical advantage of the present invention that the cross-section of the first flexible screed 26 comprises rectangle. This allows the flexible screed to be manufactured by cutting a strip from a larger sheet of material with a desired thickness. In a preferred embodiment a strip between twelve and eighteen feet in length is cut from a sheet of material. In a much preferred embodiment the material is selected from a group consisting of urethane and neoprene.

The second screed assembly 47 may be formed in the same manner as first screed assembly 25. Therefore, only first screed assembly 25 will be described in detail.

Although the present invention has been described in detail, it should be understood that various changes, substitutions and alterations can be made thereto without departing from the spirit and scope of the invention as defined by the appended claims.

What is claimed is:

1. A mobile paving system operable to produce and apply paving material to a road surface while the mobile paving system proceeds over the surface, comprising:

a vehicle operable to proceed over the road surface;

a mixer coupled to the vehicle operable to mix the paving material for application to the road surface;

a spreader box coupled to the mixer for distributing the paving material, the spreader box having a guide frame assembly attached thereto;

a strike-off assembly slidably engaged with the spreader box guide frame assembly to provide a uniform distribution of the paving material on the road surface;

the strike-off assembly including a generally elongated first screed track having a slot formed therein and a first flexible screed releasably secured within the slot;

the first flexible screed having a first surface which may be disposed adjacent to the paving material in the spreader box; and the first flexible screed having a second surface which may be disposed adjacent to the paving material in the spreader box.

2. The mobile paving system of claim 1 further comprising the first flexible screed formed from a material selected from the group consisting of urethane and neoprene.

3. The mobile paving system of claim 1 wherein the guide frame assembly further comprises:

a first guide frame assembly with a slot extending longitudinally therethrough; and the longitudinal slot generally centered along the bottom of the first guide frame assembly and formed to receive the first screed track.

4. The mobile paving system of claim 1 wherein the spreader box further comprises an expandable spreader box having variable width for distributing the paving surface material.

5. A mobile paving system operable to produce and apply paving material to a road surface while the mobile paving system proceeds over the surface, comprising:

a vehicle operable to proceed over the road surface;

a mixer coupled to the vehicle operable to mix the paving material for application to the road surface;

a variable width spreader box coupled to the mixer for distributing the paving material;

a strike-off assembly attached to the spreader box to provide a uniform distribution of the paving material on the road surface;

the strike-off assembly including a generally elongated first screed track having a slot formed therein and a first flexible screed releasably secured within the slot;

the first flexible screed having a first surface which may be disposed adjacent to the paving material in the spreader box;

the first flexible screed having a second surface which may be disposed adjacent to the paving material in the spreader box;

a first guide frame assembly having a variable length, coupled to the spreader box such that the first guide frame assembly may expand or contract in length as the spreader box expands or contracts in width;

the first guide frame assembly having a slot extending longitudinally therethrough and generally centered along a bottom portion of the first guide frame assembly; and the first guide frame assembly slot sized to receive the first screed track such that the first guide frame assembly may variably engage the first screed track.

6. The mobile paving system of claim 5 wherein the strike-off system further comprises:

the first screed track having a plurality of lateral bores extending there through;

the first flexible screed having a plurality of lateral bores extending therethrough and generally aligned with the lateral bores of the flexible track; and a plurality of pins releasably engaged with the lateral bores of the flexible track and the lateral bores of the first flexible screed operable to releasably secure the first flexible screed to the first screed track.

7. The mobile paving system of claim 5 wherein the first flexible screed further comprises a cross section corresponding generally to a rectangle, operable for distributing paving material exiting from the spreader box.

8. The mobile paving system of claim 5 wherein the strike-off system further comprises:

a second guide frame assembly, disposed adjacent to the first guide frame, with a longitudinal slot therethrough operable to variably receive a second screed track;

a second screed track variably engaged by the second guide frame assembly having a longitudinal slot therethrough operable to releasably engage a second flexible screed.

9. The mobile paving system of claim 8 wherein the strike-off system further comprises:

a second flexible screed releasably secured within the second screed track slot, having a first surface which may be disposed adjacent to the road surface operable to produce a desired surface texture of the distributed paving material; and the second flexible screed having a second surface which may be disposed adjacent to the road surface operable to produce a desired surface texture of the distributed paving material.

10. A spreader box for distributing paving material comprising:

a spreader box having a variable width for distributing the paving material;

a generally elongated first guide frame assembly having a variable width with a slot extending therethrough formed to receive a first screed track;

the first screed track slidably engaged with the first guide frame assembly slot;

the first screed track having a slot formed therein to receive a flexible screed; and a portion of the first flexible screed releasably secured within the first screed track slot disposed adjacent to the paving material exiting from the spreader box; and the first guide frame assembly slot generally centered along a bottom portion of the first guide frame assembly with a configuration selected to allow reversing the first screed track.

11. The spreader box of claim 10 further comprising:

the first flexible screed having a first surface which may be disposed adjacent to the paving material in the spreader box; and the first flexible screed having a second surface which may be disposed adjacent to the paving material in the spreader box.

12. The spreader box of claim 10 wherein the first screed track further comprises a material operable to allow the length of the first screed track not engaged with the first guide frame assembly to be directed away from the road surface.

13. The spreader box of claim 12 further comprised of:

the first screed track having a plurality of lateral bores extending therethrough, uniformly spaced at a distance between approximately one and twelve inches from each other along the length of the first flexible screed;

the first flexible screed having a plurality of lateral bores extending therethrough, uniformly spaced at a distance between approximately one and twelve inches along the length of the first flexible screed generally aligned with the lateral bores through the first screed track; and a plurality of pins removably engaged with the lateral bores of the first screed track and the lateral bores of the first flexible screed, operable to releasably secure the first flexible screed to the first screed track.

14. The spreader box of claim 13 wherein the plurality of pins comprises a plurality of spring pins operable to releasably secure the first flexible screed to the first screed track.

15. The spreader box of claim 13 further comprising:

a second guide track assembly, distal to the first guide track assembly, with an axially slot extending therethrough operable to variably receive a second screed track;

the second screed track slidably engaged with the second telescoping guide frame having an axially slot extending therethrough operable to releasably secure a second flexible screed;

the second flexible screed releasably secured within the second screed track slot, having a front surface which may be disposed adjacent to the road surface operable to produce a desired surface texture of the distributed paving material; and the second flexible screed having a second surface which may be disposed adjacent to the road surface operable to produce a desired surface texture of the distributed paving material.

* * * * *